United States Patent [19]

Peters et al.

[11] Patent Number: 4,849,167

[45] Date of Patent: Jul. 18, 1989

[54] METHOD AND APPARTUS FOR ADDING LIQUID ALLOYING INGREDIENT TO MOLTEN STEEL

[75] Inventors: Anthony T. Peters, Highland; Donald R. Fosnacht, Crown Point; John R. Knoepke, Munster, all of Ind.

[73] Assignee: Inland Steel Company, Chicago, Ill.

[21] Appl. No.: 169,884

[22] Filed: Mar. 18, 1988

[51] Int. Cl.[4] ..... C22C 33/00

[52] U.S. Cl. ..... 420/129; 75/49; 420/590

[58] Field of Search ..... 75/49; 420/85, 86, 129, 420/590; 266/207, 217, 216

[56] References Cited

U.S. PATENT DOCUMENTS

| | | | |
|---|---|---|---|
| 2,854,716 | 10/1958 | Funk et al. | 420/86 |
| 2,947,622 | 8/1960 | Tenenbaum et al. | 420/86 |
| 3,127,642 | 4/1964 | Zaeytydt | 164/154 |
| 3,756,805 | 11/1973 | Ormaechea | 420/86 |
| 4,522,784 | 6/1985 | Enright et al. | 420/590 |
| 4,602,949 | 7/1986 | Rellis | 75/49 |

FOREIGN PATENT DOCUMENTS 61-115655 6/1986 Japan .

*Primary Examiner*—Peter D. Rosenberg

*Attorney, Agent, or Firm*—Marshall, O'Toole, Gerstein, Murray & Bicknell

[57] ABSTRACT

A descending stream of molten metal is directed from a ladle into a bath of molten metal in a tundish. Molten alloying ingredient is added to the molten metal, either directly to the descending stream within a shroud, or it is injected into the bath, through a sidewall of the tundish, at a region of turbulence. The molten alloying ingredient is protected from the atmosphere outside the tundish.

17 Claims, 2 Drawing Sheets

METHOD AND APPARTUS FOR ADDING LIQUID ALLOYING INGREDIENT TO MOLTEN STEEL

BACKGROUND OF THE INVENTION

The present invention relates generally to the addition of alloying ingredients to molten metal and more particularly to the addition of liquid alloying ingredients to molten steel undergoing continuous casting.

In the continuous casting of molten steel, a descending stream of molten steel is directed from an upper container, such as a ladle, to a lower container, such as a tundish, and from there into a continuous casting mold. It is desirable to add the alloying ingredients to the descending stream of molten steel because this facilitates the mixing of the alloying ingredients into the molten steel. Certain alloying ingredients, such as lead, bismuth, tellurium and selenium, typically added to steel to improve the machinability thereof, have relative low melting points compared to steel and are prone to excessive fuming when added to molten steel. One expedient which has been employed when adding such ingredients to molten steel comprises enclosing the descending stream of molten steel within a vertically disposed, tubular shroud having vertical, peripheral walls horizontally spaced from the descending stream to define an unfilled, annular space between the shroud and the descending stream. The alloying ingredient is then directed into the descending stream inside the shroud.

Typically, the alloying ingredient is in a solid, particulate form, such as shot particles. The form in which the alloying ingredient is added is important because the amount added must be amenable to precise metering and the size and shape of the additive must be such as to assure rapid dissolution and dispersion of the alloying ingredient. Hence, the usual form of addition is either shot particles of carefully controlled size or wire or strip of uniform diameter.

When the alloying ingredient is in the form of wire or strip, a mechanical propelling device is usually employed to feed the wire or strip into the molten steel bath. When the solid alloying ingredient is introduced into the descending stream of molten steel in the form of shot, the shot is usually mixed with a compressed inert gas, such as argon, which acts as a propellant or transporting or carrying medium for the shot.

When the alloying ingredient is added to the molten steel in solid form, the molten steel must be maintained at a temperature substantially higher than that normally required for casting without the alloying ingredient, in order to insure melting and dissolution of the alloying ingredient. Additional heat energy is required to offset the heat loss and temperature drop caused by the melting of a solid alloying ingredient.

It is desirable to continuously cast molten steel at a temperature as low as possible, and the need to employ a higher temperature in order to insure the dissolution and dispersion of the alloying ingredient is therefore disadvantageous.

The addition of alloying ingredient in the form of shot, to a descending stream of molten steel, inside a surrounding shroud, and with the shot mixed with a pressurized, inert gas carrying medium, is disclosed in Rellis, et al., U.S. Pat. No. 4,602,949 entitled "Method and Apparatus for Adding Solid Alloying Ingredients to Molten Metal Stream", and the disclosure thereof is incorporated herein by reference. When a compressed gas is employed in this manner the compressed gas expands within the shroud and has a cooling effect therein.

A problem which can arise when employing an arrangement of the type described in said Rellis, et al. patent is the build-up of a skull of steel on the interior of the shroud. This is caused by the cooling effect of the expanding inert gas on droplets of molten steel which originate in the descending stream and impinge against the interior peripheral wall of the shroud. The cooling effect of the expanding pressurized inert gas causes the droplets to solidify on the interior of the shroud resulting in the build-up of the aforementioned skull, which of course, is undesirable.

SUMMARY OF THE INVENTION

The drawbacks and disadvantages of the expedients employed by the prior art, described above, are eliminated when employing an arrangement in accordance with the present invention.

In one embodiment, employing a shroud around the descending stream of molten steel, the alloying ingredient is melted and the liquid or molten alloying ingredient is directed into the shroud and into the descending stream of molten steel. The use of a pressurized, inert gas, employed as a carrying medium when the alloying ingredient was in the form of shot, is eliminated. As a result, the cooling effect arising from the expansion of the pressurized carrying gas is also eliminated, thereby reducing or eliminating skull formation within the interior of the shroud.

Because the alloying ingredient is introduced into the molten steel in liquid form, the temperature of the molten steel may be reduced as it is no longer necessary to utilize heat energy from the bath of molten steel to melt the alloying ingredient. Therefore the molten steel may be cast at a temperature as low as possible, and the molten steel may be introduced into the tundish, to form a bath therein, at a relatively low temperature.

In another embodiment, the shroud is eliminated entirely. Instead of directing the alloying ingredient into the descending stream of molten steel, between the ladle and the tundish, the alloying ingredient is melted, and the molten alloying ingredient is injected into the tundish below the surface of the bath of molten steel therein, at an injection location adjacent the location at which the descending stream of molten steel enters the tundish. Injection is performed while the stream of molten steel is entering the tundish, and the injected molten alloying ingredient is directed toward a region of the bath substantially directly below the location at which the stream enters the bath. When the descending stream is entering the bath, this is a region of relatively high turbulence, compared to a bath region remote from where the stream enters the bath, and this turbulence facilitates the mixing and dispersion of the alloying ingredient within the bath of molten steel.

Whether the molten alloying ingredient is directed into the molten steel within the shroud or injected beneath the surface of the bath of molten steel, in the tundish, the molten alloying ingredient is protected from the atmosphere outside the tundish during the directing step. This is especially desirable when the alloying ingredient is a low melting point ingredient subject to excessive fuming, such as lead, bismuth, tellurium, or selenium.

Other features and advantages are inherent in the embodiments of the invention disclosed and claimed herein or will become apparent to those skilled in the art from the following detailed description in conjunction with the accompanying diagrammatic drawings.

DETAILED DESCRIPTION

Figure 1:
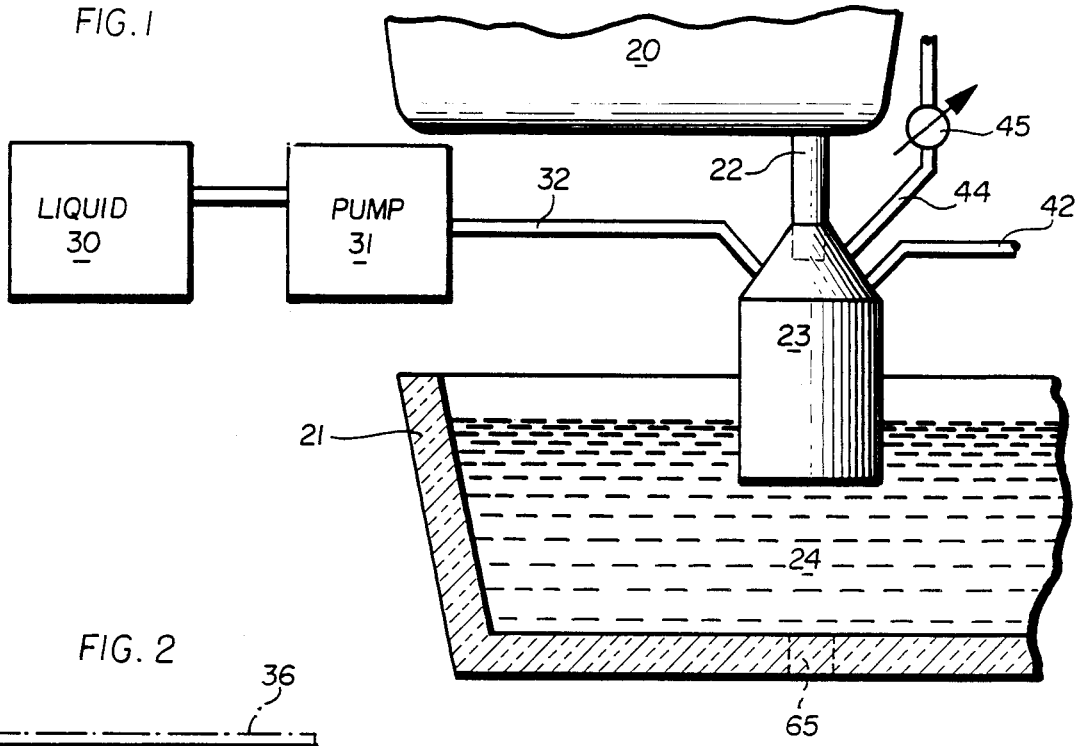
FIG. 1 is a fragmentary side view, partially in section and partially schematic, of one embodiment of the present invention.

Referring initially to FIGS. 1–4 there is shown an upper container or ladle 20 for containing molten metal such as molten steel. Located directly below ladle 20 is a lower container 21 such as a tundish constituting part of a continuous casting apparatus. Extending from the bottom of ladle 20 toward tundish 21 is an elongated, vertically disposed conduit 22 for directing a descending stream of molten steel from ladle 20 into tundish 21 to form therein a bath of molten steel 24. Molten steel from bath 24 is withdrawn from tundish 21 through bottom openings 65 located above a continuous casting mold (not shown). Ladle 20, tundish 21 and the associated continuous casting equipment are of conventional construction unless otherwise indicated herein.

Figure 4:
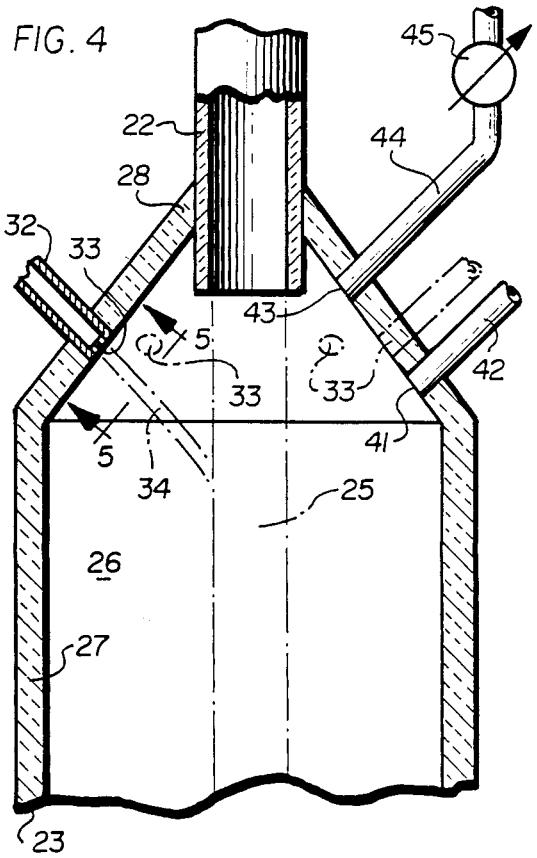
FIG. 4 is an enlarged, fragmentary, sectional view of a portion of the embodiment of FIG. 1.

The descending stream of molten metal, exiting from conduit 22 is shown in dash-dot lines at 25 in FIG. 4. Enclosing at least the bottom part of conduit 22 and descending stream 25 is a vertically disposed, tubular shroud 23 having vertical, peripheral walls 27 horizontally spaced from conduit 22 and descending stream 25 to define an unfilled, annular space 26 between (a) shroud 23 and (b) conduit 22 and descending stream 25. Shroud 23 has an upper truncated conical portion 28 through the top of which conduit 22 extends. Shroud 23 is composed of refractory material, and conduit 22 is composed of or lined with refractory material. Shroud 23 and conduit 22 are described in greater detail in the above-identified Rellis, et al. U.S. Pat. No. 4,602,949 and in Rellis, et al. allowed application Ser. No. 51,943 filed May 19, 1987, now U.S. Pat. No. 4,747,584 issued May 31, 1988, and the disclosures in both are incorporated herein by reference.

Figure 2:
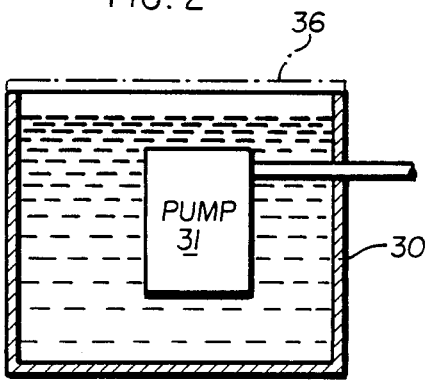
FIG. 2 is a sectional view illustrating a reservoir for molten alloying ingredient employed in the present invention.

FIGS. 1 and 2 show a reservoir 30 for holding liquid or molten alloying ingredient which is to be added to the molten steel. Molten alloying ingredient is withdrawn from reservoir 30 by a pump 31 and transported through a line 32 which extends through the shroud's upper, truncated conical portion 28 and terminates at a nozzle 33 for directing the molten alloying ingredient into the interior of shroud 23 and into the descending stream 25 of molten steel. The path of the molten alloying ingredient between nozzle 33 and descending stream 25 is indicated by dash-dot lines at 34 in FIG. 4. Pump 31 may be located on the outside of reservoir 30 (FIG. 1), or it may be located within reservoir 30 (FIG. 2).

Figure 5:
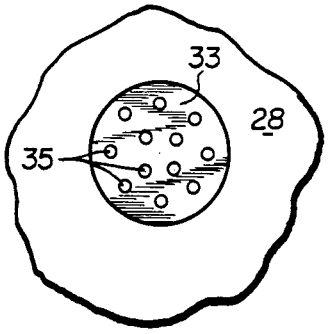
FIG. 5 is a sectional view taken along line 5—5 in FIG. 4.

As shown in FIG. 5, nozzle 33 is preferably provided with a plurality of small openings 35, 35 which facilitate the formation of droplets of molten alloying ingredient to promote the dispersion of the alloying ingredient throughout the descending stream 25 of molten steel and throughout molten steel bath 24. In those instances where the conditions surrounding the introduction of the molten alloying ingredient into the interior of shroud 23 can promote the formation of droplets of molten alloying ingredient, without the provision of small nozzle openings 35, such openings may be eliminated, and nozzle 33 may be provided with a single opening of larger size.

The liquid alloying ingredient is transported to nozzle 33 by the action of pump 31 or by gravity or by both. Reservoir 30 and line 32 are located above nozzle 33 to provide the gravity effect. The molten alloying ingredient is directed into shroud 23 without employing a carrier gas.

The liquid alloying ingredient may typically comprise one or more of lead, bismuth, tellurium and selenium, for example. These molten alloying ingredients have relatively low melting points compared to steel, and they are subject to excessive fuming. Accordingly, when these alloying ingredients are used, reservoir 30 is provided with a cover 36 shown in dash-dot lines in FIG. 2.

Figure 3:
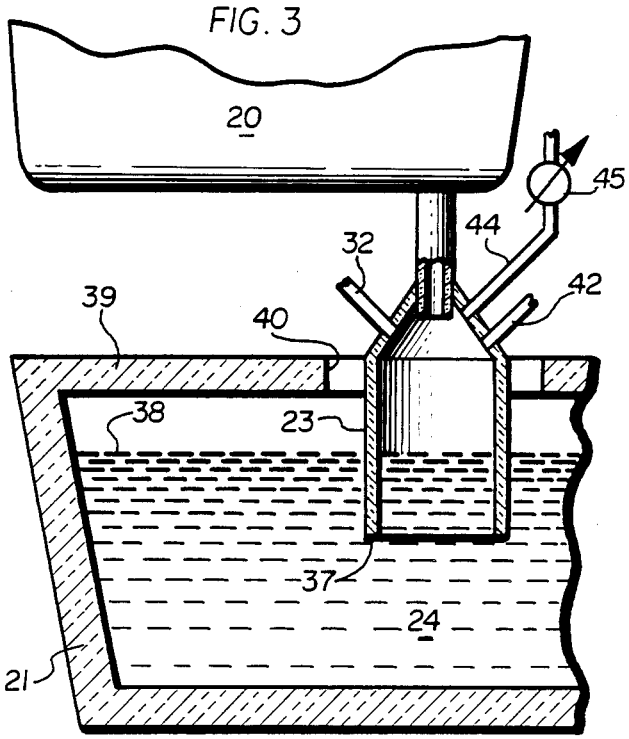
FIG. 3 is a fragmentary side view, partially in section, of the embodiment of FIG. 1.

As shown in FIG. 3, tundish 21 is provided with a top cover 39 having an opening 40 through which shroud 23 extends, and the bottom 37 of shroud 23 normally extends below the top surface 38 of molten steel bath 24 in tundish 21. The liquid alloying ingredient is protected from the atmosphere outside tundish 21 for the totality of the time during which the molten alloying ingredient is transported between reservoir 30 and tundish 21. This reduces the escape of fumes from the liquid alloying ingredient into the atmosphere surrounding tundish 21, and it reduces the reaction of liquid alloying ingredient with the surrounding atmosphere to form oxides of the liquid alloying ingredient.

The movement of molten steel stream 25 from relatively small diameter conduit 22 into relatively large diameter shroud 23 creates a venturi effect, and the result thereof is a tendency to create within shroud 23 a lower pressure than exists outside shroud 23. Unless offset by other factors, this can cause molten steel bath 24 to rise within shroud 23 to a level above the top surface 38 of bath 24 within tundish 21. This can be undesirable for a number of reasons which are described in more detail in said Rellis, et al. U.S. Pat. No. 4,602,949, the disclosure of which has been incorporated herein by reference.

To deal with this problem, structure is provided to increase the pressure within shroud 23. Communicating with the interior of shroud 23, in upper portion 28 thereof, is the outlet 41 of a line 42 communicating with a source (not shown) of inert gas, such as argon. Argon may be metered into the interior of shroud 23 through line 42 to increase the pressure within shroud 23 to the extent desired. Outlet 41 is preferably at a location remote from the location at which liquid alloying ingredient is introduced into the shroud at nozzle 33. This minimizes the cooling effect, on liquid alloying ingredient entering shroud 23 at nozzle 33, of expanding gas entering the shroud at outlet 41.

There may also be instances where it is necessary to reduce the pressure within shroud 23. Fumes of molten alloying ingredient, such as lead, may react with oxygen from air which has seeped into the interior of shroud 23 around the bottom edge thereof to form oxide vapors which accumulate within shroud 23 and increase the pressure therein. Whatever the source, excess vapors or gas may be withdrawn from the interior of shroud 23 through the inlet 43 of an exhaust conduit 44 having a control valve 45 which may be adjusted to produce the desired exhaust effect. As is evident from the above, during those periods when the pressure has to be reduced, there may be no need to introduce inert gas through outlet 41.

As noted above, liquid alloying ingredient is introduced into the interior of a shroud 23 without employing a carrier gas which was normally employed when the alloying ingredient was introduced into the shroud in the form of solid shot. The expansion of that carrier gas within shroud 23 created a cooling effect within the shroud and reduced the temperature of the interior surface of the shroud walls. As a result, droplets of molten steel which impinged against the shroud's interior surface, froze there, eventually forming a skull which was undesirable.

Introducing the alloying ingredients into the shroud in molten form, in accordance with the present invention, eliminates the carrier gas and the problems associated with the cooling effect caused by the expansion of that carrier gas within the shroud. In addition, in accordance with the present invention, the amount of pressure-controlling gas introduced into the shroud through outlet 41 is restricted so that, whatever the cooling effect there is from the expansion of that gas, it is not enough to create substantial skull formation problems. The potential pressure loss, resulting from restricting the introduction of gas at 41, is offset by restricting the amount of gas withdrawn from shroud 23 through exhaust outlet 43.

In summary, the pressure within shroud 23 can be controlled by introducing inert gas through line 42, by withdrawing gas through exhaust line 44, by controlling the amount of gas withdrawn through line 44 by adjusting valve 45, or by a combination of those expedients. A purpose of controlling the pressure within shroud 23 is to avoid the rise of molten metal from bath 24 to an undesirable level within shroud 23.

In the embodiment illustrated in FIGS. 1–4, a single nozzle 33 is shown in full lines. There may be instances where it is desirable to introduce the molten alloying ingredient into the interior of shroud 23 through a plurality of nozzles 33, 33 located at spaced locations around the periphery of shroud 23, and these additional nozzles are shown in dash-dot lines in FIG. 4. Employment of a plurality of nozzles 33, 33 would be advantageous in case one nozzle 33 plugs up temporarily.

Figure 9:
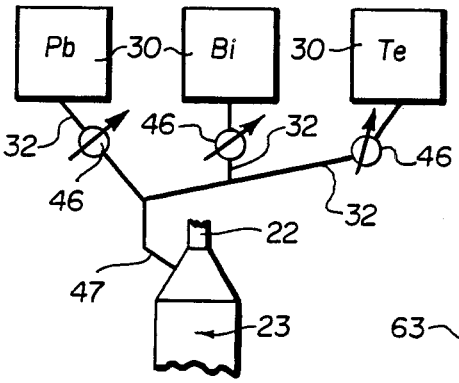
FIG. 9 is a schematic diagram of the embodiment of FIG. 1.

As noted above, the arrangement illustrated in FIGS. 1–4 is advantageously employed when the alloying ingredient has a relatively low melting point and a tendency to fume excessively when added to molten steel, examples of such alloying ingredients being lead, bismuth, tellurium and selenium or equivalents thereof from the standpoint of low melting point and excessive fuming characteristics. FIG. 9 illustrates schematically a variation of the embodiment of FIGS. 1–4 wherein a plurality of these alloying ingredients may be added together, or individually, as desired.

More particularly, referring to FIG. 9, there are three reservoirs 30, one for each of three liquid alloying ingredients: lead, bismuth and tellurium. Molten alloying ingredient is withdrawn from each reservoir 30 through a line 32 on which is located a metering valve 46. Each of the transporting lines 32 feeds into a central transporting line 47 which in turn terminates at a nozzle at shroud 23. Each of the metering valves 46 may be adjusted to control the proportion of the liquid alloying ingredient withdrawn from its respective reservoir 30, or to shut off entirely the flow of liquid alloying ingredient from that reservoir. As a result, one may introduce into the interior of shroud 23 various combinations of lead, bismuth and tellurium or one of these ingredients alone. FIG. 9 illustrates an arrangement in which the molten alloying ingredient is withdrawn from reservoir 30 and introduced into the interior of shroud 23 by gravity alone, without a pump. However, a pump is preferred in most embodiments.

Figure 6:
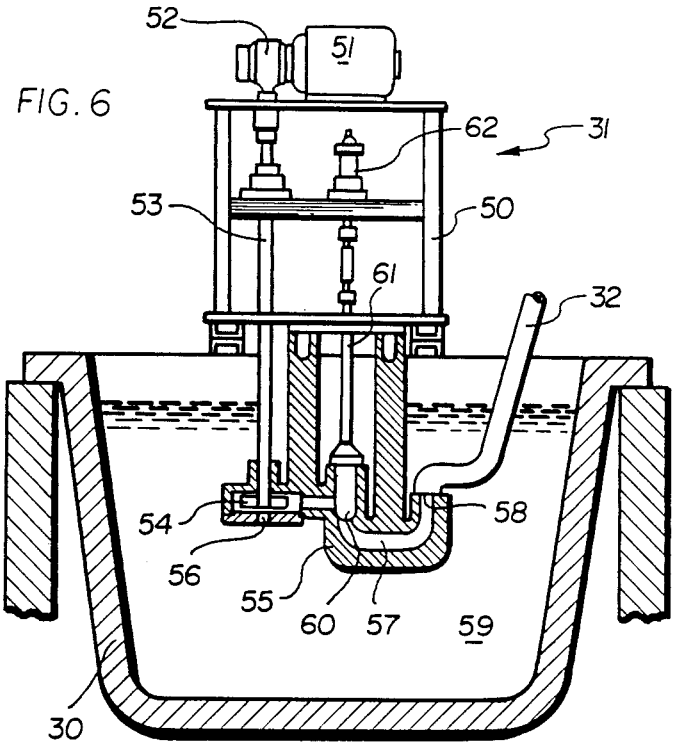
FIG. 6 is an enlarged sectional view illustrating a reservoir for molten alloying ingredient employed in the present invention.

An example of a pump 31 employed with the present invention is shown in FIG. 6. The pump of FIG. 6 is of conventional construction and typifies pumps used in conventional die casting operations for withdrawing molten die casting metal (e.g. zinc alloy) from a reservoir and pumping it to a die casting machine. Located atop reservoir 30 is a frame 50 on which is mounted an electric motor 51 connected to a gear box 52 which drives a shaft 53 which turns an impeller 54 located within a pump housing 55 disposed within a pool 59 of molten alloying ingredient in reservoir 30. Impeller 54 draws molten alloying ingredient into the pump through an inlet opening 56 communicating with a pump passage 57 terminating at an outlet opening 58 communicating with transporting line 32. Passage 57 may be blocked by a shut-off valve 60 connected to a rod 61 operated by a pneumatic cylinder 62.

The reservoir which holds the liquid alloying ingredient may be integral with a melting furnace for the alloying ingredient, e.g. as the forehearth of such a furnace. Equipment of this nature is conventionally used in connection with die casting procedures, and the same or similar equipment may be employed here. The alloying ingredient, which is in solid form before it is melted, may be virgin ingot or it may be scrap.

Figure 7:
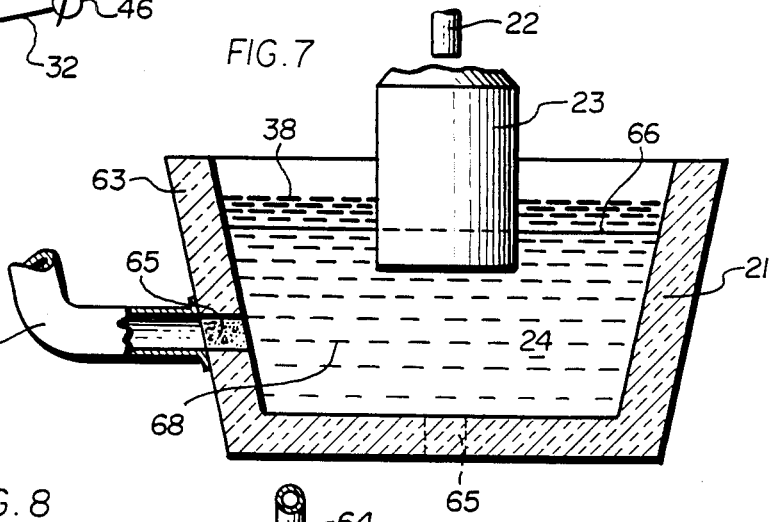
FIG. 7 is an end view, partially in section, of another embodiment of the present invention.
Figure 8:
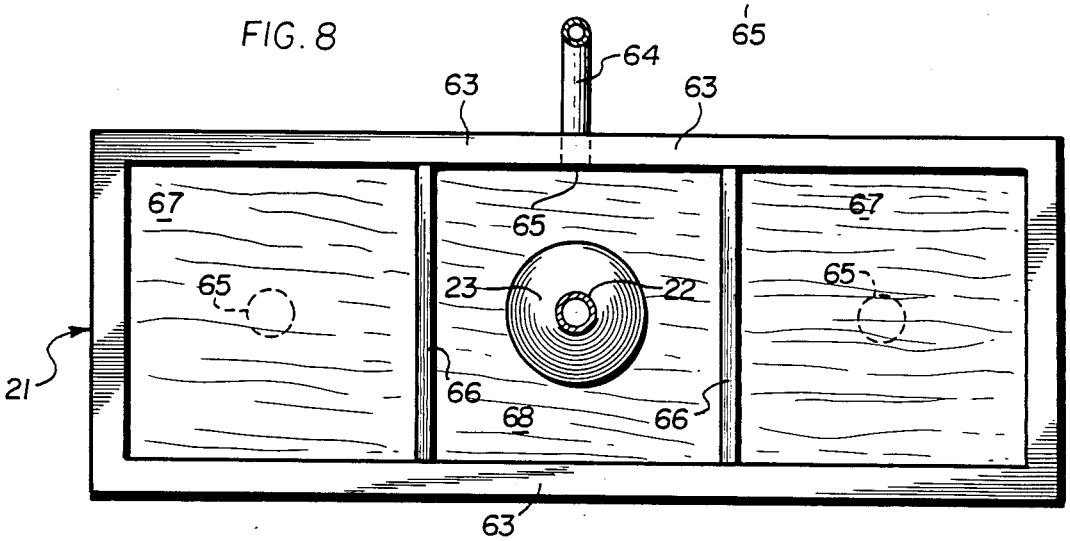
FIG. 8 is a plan view of the embodiment of FIG. 7.

FIGS. 7 and 8 illustrate another embodiment of the present invention. In this embodiment, liquid alloying ingredient is conducted through a transport conduit 64 which terminates at a porous brick 65 located in the sidewall 63 of tundish 21. Conduit 64 is composed of refractory material. Porous brick 65 is impervious to molten steel but permits the passage therethrough of liquid alloying ingredient, such as lead, bismuth or the like, particularly when the latter is injected under pressure from a pump such as 31. The molten alloying ingredient is injected into bath 24 below its top surface 38, at an injection location adjacent the location at which the vertical stream of molten steel enters bath 24 (FIG. 8). Molten steel enters bath 24 at a predetermined first location disposed directly below conduit 22 (FIG. 7), and the alignment of the injection location for the molten alloying ingredient, at 65, with the introduction location of the stream of molten steel, at 22, is shown in FIG. 8. Both locations are in substantially the same vertical plane.

The injected molten alloying ingredient is directed toward a region 68 of the bath substantially directly below the location in which the descending stream of molten steel enters the bath (FIG. 7). When that stream is entering the bath, region 68 is a region of relatively high turbulence compared to a bath region, such as 67 (FIG. 8), remote therefrom. This turbulence facilitates the dispersion throughout bath 24 of the molten alloying ingredient directed into region 68. The outer boundaries of region 68 are defined by a pair of dams 66, 66 extending between tundish sidewalls 63, 63.

Molten steel within bath 24 is withdrawn from tundish 21, while the stream is entering the bath, in a manner which controls the vertical distance between (a) the location where the stream of molten steel enters the bath, at the top thereof, and (b) the injection location, at 65, for the molten alloying ingredient. Control is exercised to maintain the level of the bath's top surface 38 above the level of injection location 65, during the time liquid alloying ingredient is undergoing injection into the bath. Control is also exercised to reduce the vertical distance between bath top surface 38 and injection location 65 to avoid too great a diminution within the bath, at the level of injection location 65, of the turbulence generated by descending steel stream 25 entering bath 24. The greater the distance between bath top surface 38 and injection location 65, the greater the diminution in turbulence at the level of injection location 65.

Because the molten alloying ingredient is injected below the top 38 of bath 24, at injection location 65, the molten alloying ingredient is protected from the atmosphere outside the tundish during the time it undergoes injection into the bath and direction toward region 68. Closed conduit 64 protects the molten alloying ingredient from the outside atmosphere between reservoir 30 and tundish 21.

Molten steel is withdrawn from bath 24 through spaced bottom openings 65, 65 located in bath regions 67, 67 remote from bath region 68 and separated from region 68 by dams 66, 66. The turbulence within region 68 assists in dispersing the molten alloying ingredient uniformly throughout the bath of molten steel. Molten metal from the bath's turbulent region 68, with alloying ingredient dispersed therein, enters remote regions 67, 67, adjacent bottom openings 65, 65, by flowing over the top of dams 66, 66.

Although a shroud is shown at 23 in FIGS. 7 and 8, the embodiment of FIGS. 7-8, wherein the molten alloying ingredient is injected into bath 24 through a porous brick in the tundish sidewall, need not employ a shroud.

An example of porous brick which permits the passage therethrough of low melting point ingredients, such as lead, bismuth, tellurium and the like, but is impervious to molten steel, is described in Japanese published application No. 61-115,655, published June 3, 1986 and filed by Shin Nihon Steel Co., Ltd., Tokyo. The disclosure thereof is incorporated herein by reference. Other examples of material from which porous brick 65 may be composed are disclosed in the allowed U.S. application of Jackson, et al., Ser. No. 88,526 filed Aug. 21, 1987, now U.S. Pat. No. 4,754,800 issued July 5, 1988, and the disclosure thereof is incorporated herein by reference.

By using the alloying ingredient in liquid form rather than in the form of solid shot, substantial savings can be realized. In the present invention, solid alloying ingredient is melted and employed directly in molten form. In the case of shot however, solid alloying ingredient has to be melted, then formed into solid shot, and then remelted into liquid again in the molten steel bath. The present invention eliminates the effort, energy and expense involved in converting liquid alloying ingredient into solid shot and then remelting it.

Because, in the present invention, the bath of molten steel is not the source of heat for melting the alloying ingredient, the bath of molten steel need not be heated to a temperature above that desirably employed in a continuous casting procedure. Preferably the bath of molten steel is at a temperature as low as possible for performing a continuous casting operation. Desirably, the bath of molten steel would be at a temperature 20° to 30° C. above the steel's liquidus temperature (e.g. 1515° C.).

Although the invention has been discussed primarily in connection with molten steel and low melting point alloying ingredients such as lead, bismuth, tellurium and the like, the invention is not limited thereto. Other alloying ingredients for molten steel may be used with the present invention. Moreover, the bath of molten metal to which the alloying ingredients are added need not be molten steel but may be any molten metal to which the present invention could be advantageously applied.

The foregoing detailed description has been given for clearness of understanding only, and no unnecessary limitations should be understood therefrom, as modifications will be obvious to those skilled in the art.

We claim:

1. In a method for adding an alloying ingredient to a vertical stream of molten metal descending from an upper container to a lower container, wherein said method comprises:

directing said descending stream through a vertically disposed conduit into said lower container;

forming a bath of said molten metal in said lower container;

enclosing at least the lower part of said conduit and said descending stream within vertically disposed, tubular shroud means having vertical, peripheral walls horizontally spaced from the descending stream to define an enclosed, unfilled, annular space between the shroud means and the descending stream;

and directing said alloying ingredient into the interior of said shroud means and into said descending stream;

the improvement comprising the steps of:

melting said alloying ingredient into molten form;

directing said molten alloying ingredient into said shroud means without employing a carrier gas;

providing within said shroud means, during at least part of said first-recited directing step, a gas which can expand within said shroud means, and controlling skull formation on the interior surface of said shroud means by restricting the amount of said expandable gas therein, to reduce the cooling effect resulting from such an expansion.

2. A method as recited in claim 1 and comprising:

exhausting gas from within said shroud means;

and adjusting the amount of gas withdrawn by said exhausting step to control the gas pressure within said shroud means.

3. A method as recited in claim 1 and comprising:

introducing a controlled quantity of inert gas into said shroud means, at a location remote from the location at which said alloying ingredient is introduced into the shroud means, to control the gas pressure within said shroud means.

4. A method as recited in claim 3 wherein said pressure controlling step further comprises:

exhausting gas from within said shroud means;

and adjusting the amount of gas withdrawn by said exhausting step.

5. A method as recited in claim 3 and comprising:

controlling the gas pressure within said shroud means to avoid the rise of molten metal from said bath to an undesirable level within said shroud means.

6. A method as recited in claim 1 wherein said step of directing said alloying ingredient into said shroud means comprises:

introducing said molten alloying ingredient into the shroud means at a plurality of spaced locations around the periphery of the shroud means.

7. A method as recited in claim 1 wherein:

said alloying ingredient has a relatively low melting point and a tendency to fume excessively when added to molten metal.

8. A method as recited in claim 7 wherein:

said alloying ingredient is at least one of the group consisting of lead, bismuth, tellurium, selenium and equivalents thereof.

9. A method as recited in claim 7 wherein:

said molten metal is steel;

and said alloying ingredient is at least one of the group consisting of lead, bismuth, tellurium, selenium and equivalents thereof.

10. A method for adding an alloying ingredient to molten metal, said method comprising the steps of:

directing a descending, vertical stream of said molten metal into a tundish at a predetermined first location therein, to form a bath of molten metal in said tundish;

melting said alloying ingredient into molten form;

transporting said molten alloying ingredient to said bath;

injecting said molten alloying ingredient into said bath, below the surface thereof, at an injection location adjacent said first location, while said stream of molten metal is entering said bath;

preventing molten bath metal from escaping from said bath at said injection location;

and directing said injected molten alloying ingredient toward a region of said bath substantially directly below said first location.

11. A method as recited in claim 10 wherein said tundish has a sidewall and wherein said method comprises:

injecting said molten alloying ingredient through said tundish sidewall while preventing molten bath metal from escaping through said sidewall.

12. A method as recited in claim 10 wherein:

said injection location is in a bath region of relatively high turbulence compared to a bath region remote therefrom.

13. A method as recited in claim 10 and comprising:

withdrawing molten metal from said tundish while said stream is entering said bath to control the vertical distance between said first location and said injection location.

14. A method as recited in claim 10 and comprising:

protecting said molten alloying ingredient from the atmosphere outside said tundish during said directing step.

15. A method for adding an alloying ingredient to molten metal, said method comprising the steps of:

directing a descending stream of molten metal into a container to form a bath of molten metal therein;

melting said alloying ingredient into molten form;

transporting said molten alloying ingredient toward said bath;

subjecting said transported molten alloying ingredient to a directing step selected from the group consisting of (a) directing said molten alloying ingredient into said descending stream while providing, during at least part of said first-recited directing step, a gas which can expand adjacent the location where said molten alloying ingredient is directed into the descending stream, while restricting the amount of said expandable gas at said location to reduce to the cooling effect resulting from such an expansion, and (b) directing said molten alloying ingredient into a region of said bath substantially directly below the location where said stream enters said bath;

and protecting said molten alloying ingredient from the atmosphere outside said container during said transporting and directing steps.

16. A method as recited in claim 15 wherein:

said container is a tundish used for the continuous casting of molten steel;

said molten metal is molten steel;

said method comprises continuously casting said bath of molten steel from said tundish;

and said molten steel bath in the tundish has a temperature substantially no higher than the temperature employed for the continuous casting of said molten steel when said alloying ingredient is not added to said bath.

17. A method as recited in claim 16 wherein:

said molten steel bath has a temperature not greater than about 30° C. above the liquidus temperature of the steel.

* * * * *